United States Patent [19]

Takahashi et al.

[11] 4,173,117

[45] Nov. 6, 1979

[54] ELECTRONIC TIMEPIECE

[75] Inventors: Kazutoshi Takahashi; Tatsuo Nitta; Ryoji Iwakura, all of Tokorozawa, Japan

[73] Assignee: Citizen Watch Co., Ltd., Tokyo, Japan

[21] Appl. No.: 844,866

[22] Filed: Oct. 25, 1977

[30] Foreign Application Priority Data

Nov. 25, 1976 [JP] Japan ..... 51/141417

[51] Int. Cl.[2] ..... G04C 3/00

[52] U.S. Cl. ..... 58/85.5; 58/23 R

[58] Field of Search ..... 58/23 R, 34, 85.5

[56] References Cited

U.S. PATENT DOCUMENTS

| | | | |
|---|---|---|---|
| 3,939,641 | 2/1976 | Nishimura et al. | 58/85.5 |
| 4,030,283 | 6/1977 | Sauthier et al. | 58/85.5 |
| 4,043,111 | 8/1977 | Fujita | 58/85.5 |
| 4,044,547 | 8/1977 | Kusumoto | 58/85.5 |
| 4,055,945 | 11/1977 | Schwarzschild et al. | 58/85.5 |

*Primary Examiner*—Gene Z. Rubinson
*Assistant Examiner*—Forester W. Isen
*Attorney, Agent, or Firm*—Frank J. Jordan

[57] ABSTRACT

An electronic timepiece equipped with a differentiation carry inhibit circuit arranged to allow a carry operation due to a carry signal produced by a time counter in response to a time unit signal when the timepiece remains in a time correction mode and inhibit a carry operation due to a carry signal arising from a correction signal produced by actuation of a correction switch.

5 Claims, 5 Drawing Figures

Fig. 2a | Fig. 2b

ELECTRONIC TIMEPIECE

Figure 1:
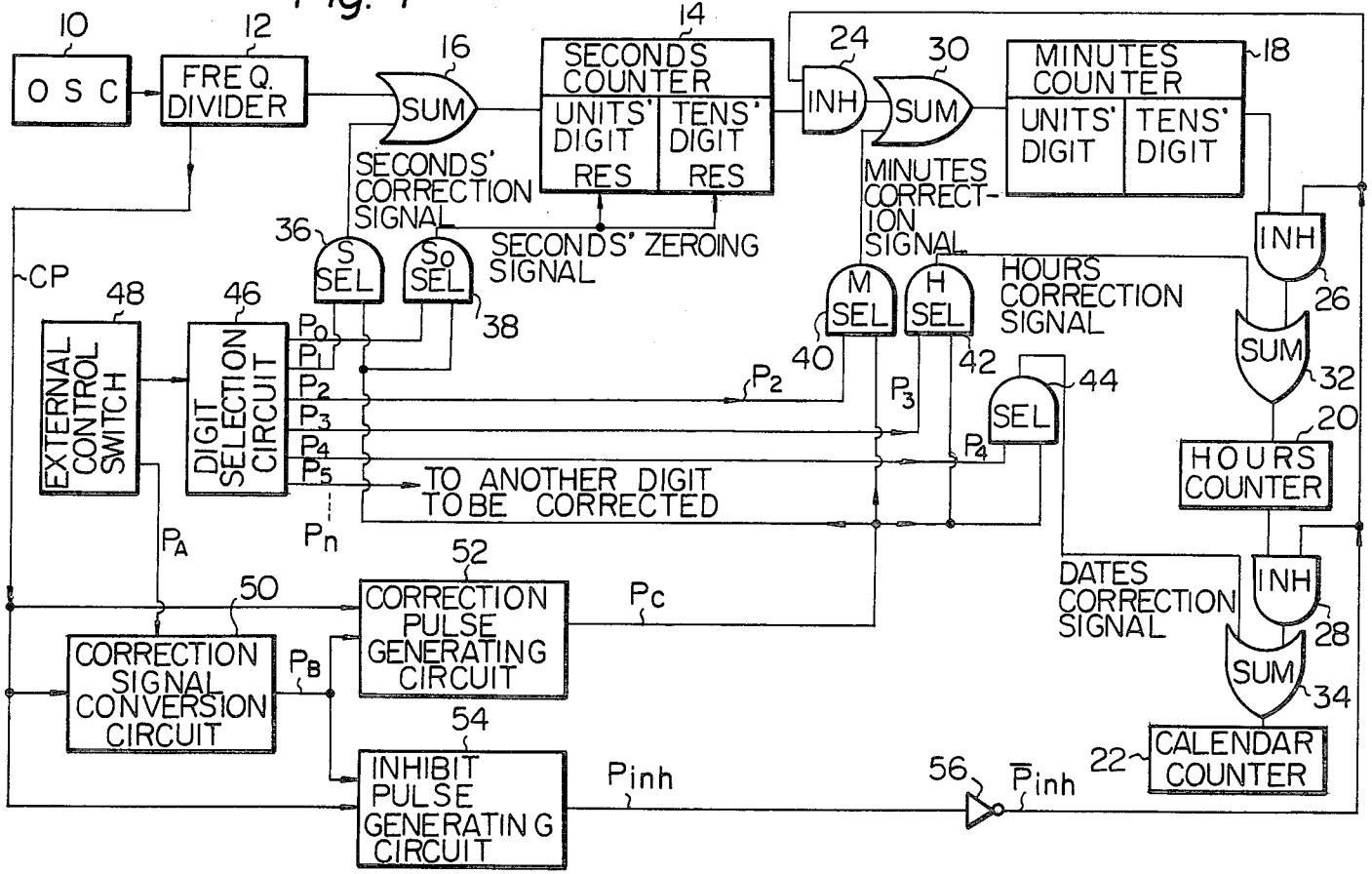

This invention relates to an electronic timepiece equipped with a novel time correction mechanism.

In conventional electronic timepieces two methods of time correction are in general use. In the 1st method, "objective time data" is produced by means of a specially provided data forming mechanism and applied as an input to a time-keeping counting mechanism for the timepiece at the instant that the standard time comes into agreement with the objective time thereby to bring the two into coincidence and thus synchronize the timepiece. According to this method, the maintained time as read on the timepiece is caused to jump in a non-continuous manner and it is possible to rapidly correct large-scale time aberrations. This method is particularly convenient when the timepiece is initially set. Moreover, the timepiece is stopped from the moment the correction is initiated until the accurate time setting has been attained, only the counted value of the time-keeping counter being optionally changed. In the 2nd method, aberrations in time are continuously compensated for by inputting so-called "error data." In other words, the amount of error is continuously compensated for by removing pulses from or inserting pulses into the time unit signal pulse train that is being applied to the counting mechanism during time-keeping.

Quartz timepieces in common use are designed to effect time corrections by means of the 2nd method. Although this presents somewhat of an inconvenience due to the fact that the initial time setting requires patience, it is preferable over the 1st method with respect to extremely small time corrections while the timepiece is in use. However, some disadvantages do exist. Namely, even though the fundamental theory of the 2nd method is based upon error compensation by altering time-keeping speed without stopping the timepiece, the actual circuitry involved is designed to inhibit a carry operation at all times whenever the timepiece is in the time correction mode; hence, the count from the carry portion to the next upper ranking digit is not allowed to take place. Furthermore, circuit design tends to become complicated since the structure of the carry inhibit circuitry is different depending upon the corrections for each individual digit.

According to the circuitry of the present invention, it is possible to eliminate the defects relating to the carry inhibit portion of the 2nd correction method and yet maintain the principle of applying an input signal which will allow any desired digit to be corrected by a suitable amount. It is also possible to preclude time-keeping aberrations even if the timepiece is left in the correction mode so long as the correction operation is not performed.

More specifically, conventional carry inhibit circuitry during a time correction operation made use of carry inhibit signals which differed in conformance to the digits to be corrected such that a carry from a minutes to an hours digit was inhibited during a minutes digit correction, and a carry to a date digit was inhibited during an hours digit correction. According to the present invention, it is possible to design a simple carry inhibit circuit by using a standard carry inhibit signal to inhibit a carry operation which will apply to all digits during a correction.

In accordance with the conventional design of a time correction circuit, a carry inhibit operation during a correction is either performed when the timepiece is in a correction mode or is not performed at all. In a case where no carry inhibit is performed, there are frequently occasions when the time is advanced too much during a minutes digit correction so that an hours digit undergoes a carry operation; since it is not ordinarily possible to reverse the procedure, the second time the minutes digit is set correctly the indicated time will be 1 hour fast.

In some circuits the carry inhibit operation is allowed to remain in effect during the correction mode. In such a circuit, when a carry signal appears for an upper ranking digit of a digit to be corrected in response to the advance of such digits by a carry signal from a lower ranking digit during a correction, the upper ranking digit is not advanced so that this digit must be corrected following the correction of the digit which was originally to be corrected. In other words, a time aberration will result if the correction state is prolonged for some reason.

According to the present invention, the timepiece is arranged such that even during the correction mode a differentiation carry inhibit signal will be generated by a differentiation carry inhibit circuit to inhibit a carry signal that arises from a correction signal which is an advancing pulse for correcting an error. However, the carry operation due to the carry signal arising from the input signal for the time-keeping operation of the time counter will proceed without being affected. This is because of the fact that the carry inhibit signal is in synchronism with the carry signal that arises from the correction signal and comprises a differentiation pulse having a predetermined narrow pulse width which covers an active portion of the carry signal that arises from the correction signal.

Figures 2, 2A:
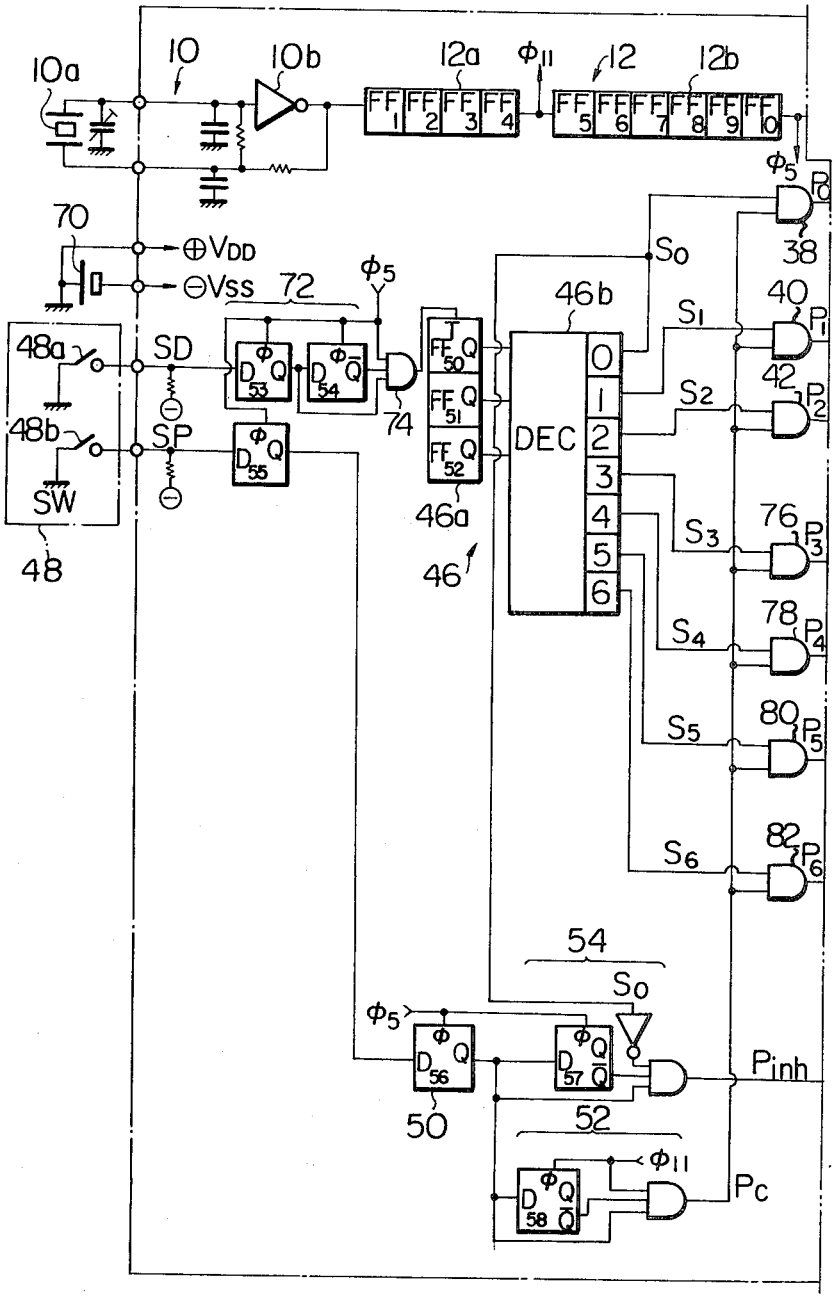
Figure 2B:
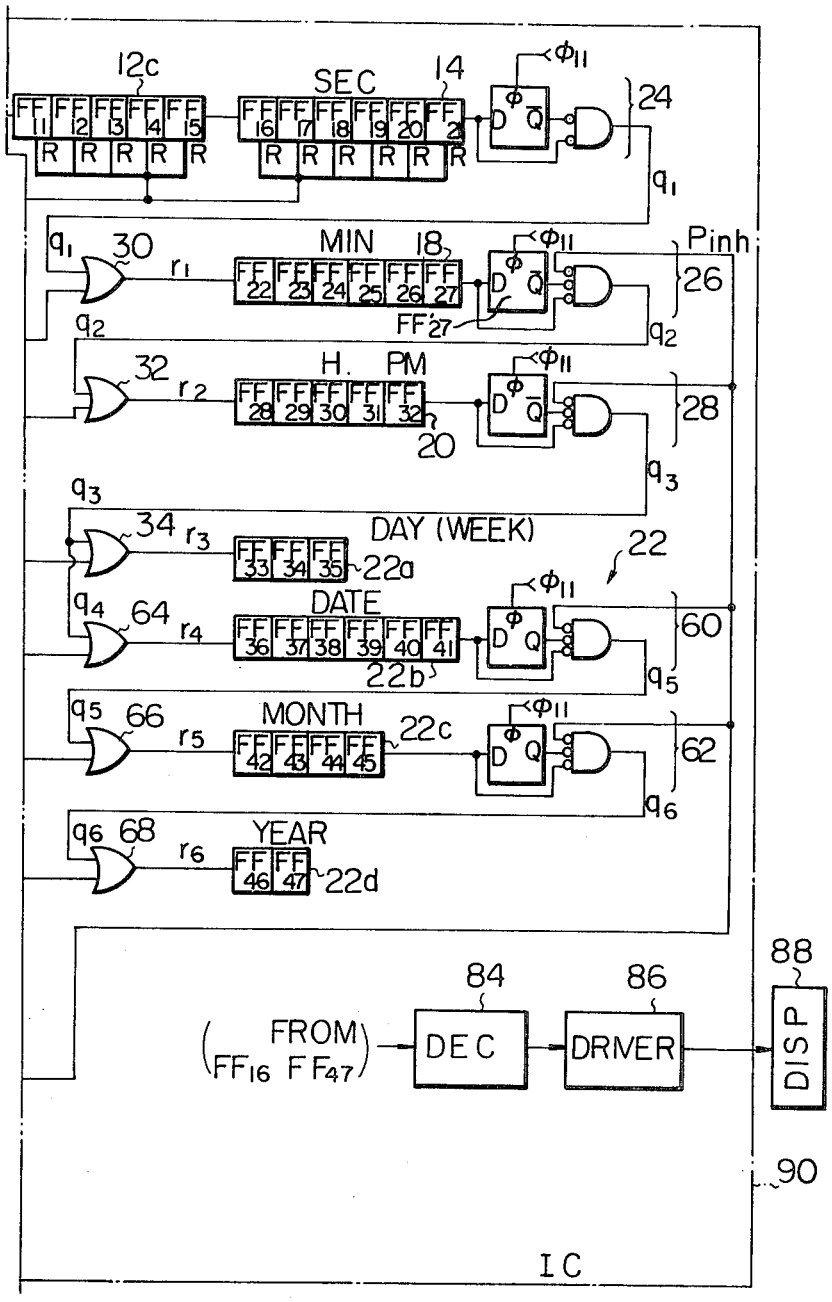
Figure 3:
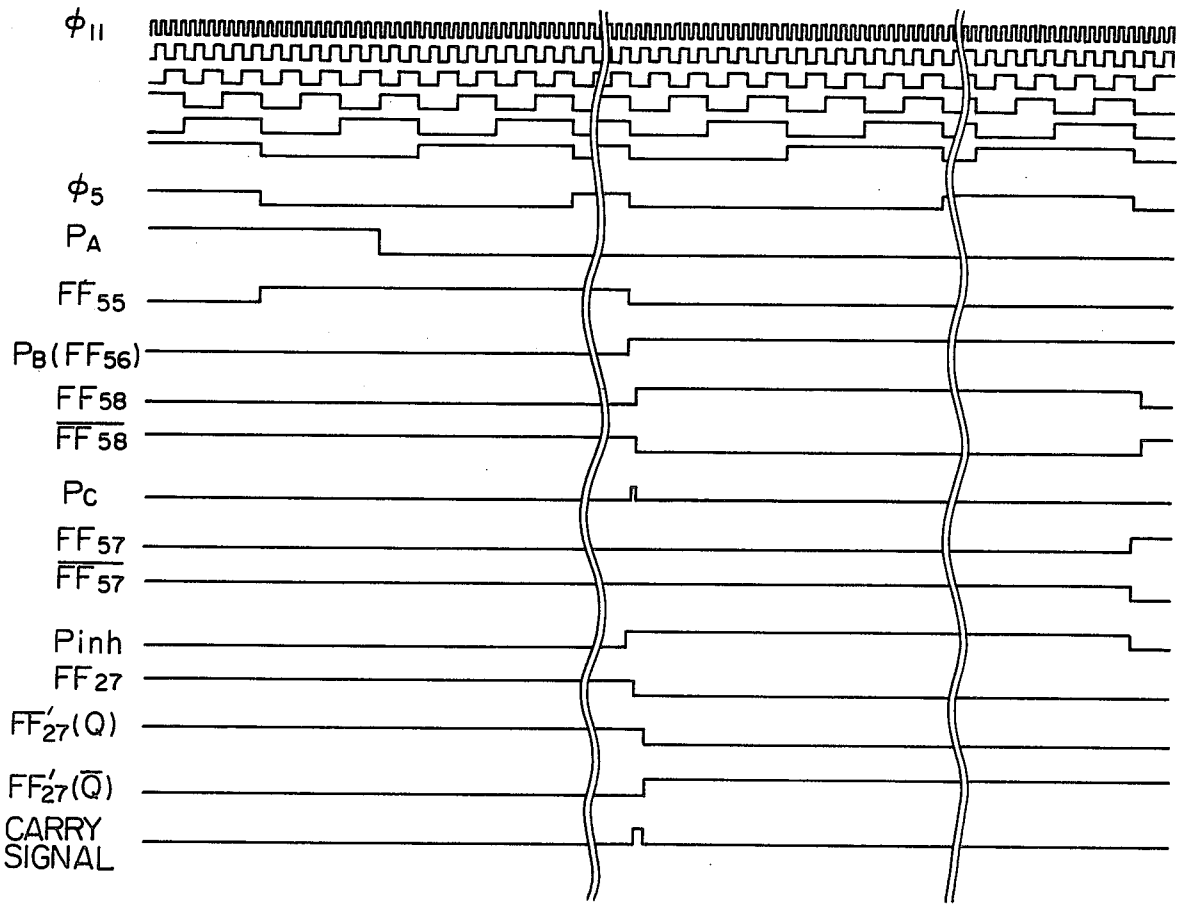

These and other objects, features and advantages of the present invention will become more apparent from the accompanying drawings, in which:

FIG. 1 is a block diagram of a preferred embodiment of an electronic timepiece according to the present invention;

FIGS. 2*a* and 2*b* show a detailed circuitry for the timepiece of FIG. 1; and FIG. 3 is a time chart of various signals produced in the timepiece of FIGS. 2*a* and 2*b*.

A more detailed description of the invention will now be had with reference to the accompanying drawings, in which FIG. 1 is a block diagram of a preferred embodiment and FIGS. 2*a* and 2*b* illustrate a detailed circuitry for the timepiece shown in FIG. 1. FIG. 3 shows a timing chart of various signals produced in the circuit of FIGS. 2*a* and 2*b*.

Before entering into a detailed description of the invention, it should be noted that while a preferred embodiment of the invention will be described as employing an inhibit signal common to all digits, it may be possible to use inhibit signals independently produced for each digit.

In FIG. 1, a relatively high or output frequency signal from a frequency standard such as an oscillator 10 is divided down to a low frequency signal, i.e., a frequency of 1 pulse/sec by means of a frequency converter or divider 12 and applied to a seconds counter 14 where it is counted after passing through OR gate 16 which produces seconds correction signals. Carry signals from seconds counter 14 to minutes counter 18, from minutes counter 18 to hours counter 20, and from hours counter 20 to calendar counter 22, as well as a differentiation carry inhibit signal Pinh are applied to respective AND gates 24, 26 and 28 the outputs of which are fed to respective OR gates 30, 32 and 34 along with the corresponding minutes, hours and dates correction signals. The outputs obtained from these OR gates are applied to minutes counter 18, hours counter 20 and calendar counter 22, respectively.

Reference numerals 36, 38, 40, 42 and 44 designate gates which apply correction signals only to those digits which are to be corrected as selected by digit selection circuit 46. Reference numeral 48 designates an external control switch, 46 a digit selection circuit which selects a digit for correction as instructed by control switch 48, and reference numeral 50 denotes a correction signal conversion circuit for shaping the output PA of the external control switch 48 responsive to a clock pulse CP. A correction pulse generating circuit 52 and inhibit pulse generating circuit 54 are supplied by correction signal conversion circuit 50 with a signal PB and produce a correction pulse PC and carry inhibit pulse Pinh, respectively.

Symbols P1 through P4 denote signals obtained from digit selection mechanism 46 and correspond to seconds, minutes, hours and date. No two of these signals are ever at a high or an H logic level at the same time; a signal at an H level is indicative of a correction for the corresponding digit. In correction pulse conversion circuit 52, signal PB is converted to a correction signal PC which has a narrower pulse width than PB and is delayed in time from PB. As shown in FIG. 2, the differentiation carry inhibit signal Pinh is in synchronism with the carry signal, i.e., in synchronism with the phase in which the carry signal arises from a correction pulse Pc. The differentiation carry inhibit signal is produced each time the correction pulse Pc is produced, irrespective as to whether the carry signal arising from the correction signal is produced or not. In order to let the differentiation carry inhibit signal to be in synchronism with the phase in which the carry signal arising from the correction signal is produced, the differentiation carry inhibit circuit is arranged to produce a differentiation carry inhibit signal in fixed phase relationship with respect to an output signal PB produced when the correction switch is actuated. In this illustrated embodiment, it has been shown that there is no time delay between the correction pulse and the carry signal arising from the correction pulse and the whole of the carry signal serves as an active range for the carry operation, and that the differentiation carry inhibit signal was described as being in synchronism with the correction pulse and having a pulse width in which the correction pulse appears. In a usual practice, however, there is a time delay between the correction pulse and the carry signal arising from that correction pulse and, in some cases, the whole of the carry signal is not active for the carry operation but only a portion of the carry signal is active for that carry operation. Thus, the differentiation carry inhibit pulse should have a pulse width, depending upon the active range of the carry signal, for inhibiting the active range of the carry signal arising from the correction pulse in accordance with the timing at which the carry signal is produced. Here, the active range means a portion of the carry signal which enables a carry operation from a lower digit to a higher digit in the time counter. In this illustrated embodiment, further, while the carry inhibit is performed by means of an inhibiting gate, it should be noted that the time counter may be arranged so as not to perform writing-in of the carry signal in response to the differentiation carry inhibit pulse without using the inhibiting gate. In a seconds zeroing mode in which signal Po is at an H level, the signal Pc is applied through gate 38 to the reset terminals of the seconds counter 14 and also applied to the carry inhibit gates for all digits; there is no carry for 0 to 29 seconds but a carry is performed for 30 to 59 seconds with respect to minutes, hours as well as calendar and days of the week digits.

In the present description, digits will be taken to mean single digits or counters of respective blocks when each single block represents seconds, minutes, hours and date. Further, a very short period of time in the carry inhibit of the present invention will be defined as a pulse width of the inhibit signal Pinh. The correction mode is the state in which at least any of digit selection signals P0–P4 or P5–Pn is selected.

With reference to FIGS. 2*a* and 2*b*, reference numeral 10*a* denotes a crystal oscillator and 10*b* a circuit for amplifying its oscillations, both of these circuits constructing the crystal controlled oscillator 10. Reference numerals 12*a* and 12*b* designate frequency dividers which, for example, divide a $2^{15}$ Hz output obtained from oscillation amplifier 10*b* down to a frequency of $2^5$ Hz which will serve as a time unit signal. Reference numeral 12*c* operates as a portion of a time counter and is equipped with reset terminals. Reference numerals 14, 18, 20, 22*a*, 22*b*, 22*c* and 22*d* denote seconds, minutes, hours, PM, days of the week, date, months and years counters, respectively, and 24, 26, 28, 60 and 62 designate the corresponding differentiation circuits for generating differentiation pulses in response to the output pulses provided by the respective counters. When the inputs to the differentiation circuits are negative going, the differentiating circuits are synchronized to the negative going portion of $\phi_{11}$ and produce a single narrow pulse, which is used as a carry signal, having a pulse width equal to the period of $\phi_{11}$. Reference numerals 30, 32, 34, 64, 66 and 68 are OR gates which serve as signal adding mechanism and, in response to carry signals $q_1$–$q_6$, produce input signals $r_1$–$r_6$ which are applied to the seccessive set of counters. Correction signals P1–P6 are separately produced and applied to the respective adders 30, 32, 34, 64, 66 and 68. An inhibit signal Pinh is applied to differentiation circuits 26, 28, 60 and 62 and, while at a high level, prevents these circuits from producing the narrow pulse signals $q_2$–$q_6$ which serve as the carry signals. Reference numeral 70 denotes a battery power supply, and 48*a* and 48*b* represent external control switches which are associated with external control buttons; a normal state is indicated when the switch is in the OFF position, and an active state is attained when the switch is ON.

Reference numeral 72 represents a circuit on the input side and is designed to remove switching noise from the input signals; the output obtained from the circuit is a noise-free signal which is synchronized with the negative-going portion of the clock pulse $\phi_5$. Reference numeral 74 is a gate for generating differentiation pulse signals, the output signals obtained from the gate being individual narrow pulses in coincidence with $\phi_5$. Reference numeral 46*a* denotes a digit selection counter which is driven by the output provided by gate 74, and 46*b* designates a decoder which generates digit selection signals from S0 to S6 in response to the content of digit selection counter 46*a*. The inhibit pulse generating circuit 54 comprises a differentiation circuit which is in synchronism with the negative-going portion of $\phi_5$ and generates a single pulse Pinh in coincidence with $\phi_5$. The pulse Pinh is generated only when the digit selection counter is in a selected state, i.e., when the counters are in one of the correction states 1 through 6. The correction pulse generating circuit 52 comprises a differentiation circuit which is in synchronism with the negative-going portion of $\phi_5$ and produces an up-date signal $P_{UD}$ in coincidence with $\phi_{11}$. In using two clock pulses $\phi_5$ and $\phi_{11}$, $\phi_5$ changes in response to the negative-going portion of $\phi_{11}$ and possesses a frequency which is far lower than that of $\phi_{11}$, such as 1/64th its frequency; hence, the following relationship results:

$$Pinh \cdot Pc = Pc.$$

Carry signals arising from Pc will agree in phase with Pinh=H and thus will be inhibited even if the signals should be generated by gates 26, 28, 60 and 62 after a certain delay. Reference numerals 38, 40, 42, 76, 78, 80 and 82 denote gates for forming the correction signals, the correction signals being produced by taking the logical product of Pc and S1–S6. Reference numeral 84 designates a display decoder, 86 a display driver, 88 and 90 a display device, a portion of an IC in accordance with the system of the invention.

It will now be appreciated from the foregoing description that in accordance with the present invention a carry operation arising from a correction signal applied to a selected digit is inhibited within a short period of time and allowed to be effected during a time period other than the short period of time to perform timekeeping operation whereby a time aberration will not result even if the correction state is prolonged for some reason.

While the present invention has been shown and described with reference to a particular embodiment by way of example, it should be noted that various other changes or modifications may be made without departing from the scope of the present invention. For example, the correction pulse may be produced in response to the differentiation carry inhibit signal, or in response to the digit selection signal and vice versa, though not shown.

What is claimed is:

1. In an electronic timepiece having a frequency standard providing an output frequency signal, a frequency converter responsive to said output frequency signal to provide a low frequency time unit signal and a clock signal, a time counter composed of a plurality of counter circuits responsive to the time unit signal to provide time information signals, display means for providing a display of time information in response to said time information signals, correction gate means coupled to each of said counter circuits for applying correction pulses and a carry signal from a previous stage counter circuit to a succeeding counter circuit to which said correction gate means is coupled, and inhibiting gate means coupled to each of said counter circuits and responsive to a carry inhibiting signal to inhibit carry operation due to said carry signal arising from said correction pulses, the improvement comprising:

a correction switch for producing a correction signal when actuated;

a digit selection switch for producing a digit selection signal when actuated;

digit selection circuit means for selecting a digit to be corrected in response to said digit selection signal;

means for producing an output signal having a first predetermined pulse width in response to said correction signal and said clock signal;

means for generating said correction pulses of a predetermined second pulse width narrower than said first predetermined pulse width in response to said output signal and said clock signal; and means for producing said carry inhibiting signal of a third predetermined pulse width narrower than said first predetermined pulse width but larger than said second predetermined pulse width, said carry inhibiting signal producing means including a single differentiating circuit having its clock input terminal connected to said frequency converter to receive said clock signal and its data input terminal connected to receive said output signal to produce said carry inhibiting signal composed of a differentiation pulse of said third predetermined frequency.

2. The improvement according to claim 1 in which said clock signal comprises a first clock pulse of a first frequency, and a second clock pulse of a second frequency lower than said first frequency.

3. The improvement according to claim 2, in which said output signal producing means is responsive to said second clock pulse.

4. The improvement according to claim 2, in which said correction pulse generation means is responsive to said first clock pulse.

5. The improvement according to claim 2, in which said carry inhibiting signal producing means is responsive to said second clock pulse.

* * * * *